US007489071B2

(12) United States Patent
Chien et al.

(10) Patent No.: US 7,489,071 B2
(45) Date of Patent: Feb. 10, 2009

(54) FIELD EMISSION SYSTEM AND METHOD FOR IMPROVING ITS VACUUM

(75) Inventors: Yu-Han Chien, Hsinchu (TW); Chih-Ping Peng, Hsinchu (TW); Chuan-Hsu Fu, Hsinchu (TW); Wei-Yi Lin, Hsinchu (TW); Lih-Hsiung Chan, Hsinchu (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 276 days.

(21) Appl. No.: 11/593,499

(22) Filed: Nov. 7, 2006

(65) Prior Publication Data

US 2008/0042547 A1 Feb. 21, 2008

(30) Foreign Application Priority Data

Aug. 18, 2006 (TW) ..... 95130455 A

(51) Int. Cl.
*H01J 1/62* (2006.01)

(52) U.S. Cl. ..... 313/495; 313/309

(58) Field of Classification Search ..... 313/495, 313/309, 310, 336, 351
See application file for complete search history.

(56) References Cited

U.S. PATENT DOCUMENTS 6,771,012 B2 * 8/2004 Ahmed et al. ..... 313/336
6,777,869 B2 * 8/2004 Pavlovsky ..... 313/496

* cited by examiner

*Primary Examiner*—Vip Patel
(74) *Attorney, Agent, or Firm*—Birch, Stewart, Kolasch & Birch, LLP

(57) ABSTRACT

The present invention provides a field emission system and a method for improving its vacuum. The present invention employs aging surface-unsaturated carbon nanotubes in non-display areas of the field emission system as getter material to absorb residual gas within the system so as to improve its vacuum. The present method for improving vacuum of the field emission system can be integrated with the standard process of a field emission display device without additional fabricating steps, and thus facilitating the mass production of the field emission display device.

23 Claims, 6 Drawing Sheets

FIELD EMISSION SYSTEM AND METHOD FOR IMPROVING ITS VACUUM

BACKGROUND OF THE INVENTION

1. Field of the Invention

The present invention relates to a field emission system and a method for improving its vacuum, and more particularly, to a field emission system employing surface-unsaturated nanomaterial as getter material.

2. Description of Related Art

In field emission display (FED) devices, each pixel contains several hundreds to thousands of micro-tip emitters or cabon nanotubes (CNTs) formed on a back plate of the field emission display device to serve as electron emission sources, and a phosphor layer emitting light by way of being bombarded by electrons from the electron emission sources is formed on a front plate of the field emission display device. A gap between the front plate and the back plate of the field emission display device is usually about 200 μm to several millimeters (mms). The display must be maintained in a high vacuum level so that electrons move without energy loss.

FIG. 1 is a schematic cross-sectional view of a conventional field emission display device. The conventional field emission display device includes a front plate 100 and a back plate 110 that are spaced from one another by a gap. An anode array 101 and a cathode array 111 are respectively formed on opposite inner surfaces of the front plate 100 and the back plate 110. A gate insulating layer 112, in which holes 112*a* are formed, is disposed on the cathode array 111, and the holes 112*a* make partial portions of the cathode wires of the cathode array 111 being exposed. A plurality of gate electrodes 113 corresponding to the holes 112*a* are formed on the gate insulating layer 112. A plurality of carbon nanotubes 114 grow on the exposed partial portion of the cathode wire in each of the holes 112*a* is served as field emission source, and the carbon nanotubes 114 in each of the holes 112*a* corresponds to one pixel unit. A phosphor layer 102 corresponding to the carbon nanotubes 114 are formed on the lower portion of the anode array 101, and a black matrix 103 for improving contrast and color purity of the field emission display device is formed in the phosphor layer 102 and inter-disposed with pixel units. An exhausting channel 115 passes through one side of the back plate 110 for exhausting residual gas, and a sealing cap 116 is used for sealing the outlet of the exhausting channel 115. A gas channel 117 passes through the other side of the back plate 110, and a getter container 118 including a getter 119 for absorbing residual gases inside the panels is connected to one end of the gas channel 117 and protruded outwardly from the back plate 110.

In the field emission process, if there are residual gases in the vacuum field emission system, these residual gas molecules would interact with field emission electrons and becomes ionized. The ionized species are accelerated toward the cathode under the application of electric field, and finally bombarding onto the surface of emitters with a certain quantity of energy. It is so-called ion bombardment. Under the influence of ion bombardment, the shape of the emitter tip is gradually deteriorated, and the distribution of electric field is affected. Finally, the field emission current decreases and even disappear. The field emission process may not be performed in an absolute vacuum level. Therefore, the decrease of the field emission performance caused by ion bombardment is almost unavoidable. However, ion bombardment strength is correlated with the vacuum level of the system very much. The higher the vacuum level is, the less the residual gas is, and ion bombardment becomes weaker. As shown in FIG. 1, conventionally the getter 119 is used to absorb most of gas molecules and ions inside the panel to decrease the ion bombardment effect. Because the getter 119 absorbs gas through the gas channel 117 which is narrow and has a quite large gas-flow resistance, the getter 119 would not effectively absorb gas inside the panel. In other words, it is difficult for the getter 119 to absorb the residual gas far away from the gas channel 117. The vacuum level of the field emission display device is limited.

Accordingly, it is an intention to provide an improved getter device applicable in the field emission display device to alleviate the drawbacks of the conventional field emission display device.

SUMMARY OF THE INVENTION

The present invention is to provide a field emission system and method for improving its vacuum, which employs aging surface-unsaturated carbon nanotubes as getter agent to absorb residual gas within the system so as to improve its vacuum.

A field emission system of the present invention comprises an upper substrate; a lower substrate disposed under the upper substrate and a field emission area and a getter area defined therebetween; an anode array formed on an inner surface of the upper substrate corresponding to the field emission area and including at least one first anode wire; a phosphor layer formed under the anode array; a cathode array formed on an inner surface of the lower substrate corresponding to the anode array and including at least one first cathode wire; a carbon nanotube (CNT) field emission array including a plurality of carbon nanotube units formed on the at least one first cathode wire and each of carbon nanotube units including a plurality of carbon nanotubes; at least one second anode wire formed on the inner surface of the upper substrate corresponding to the getter area; at least one second cathode wire formed on the inner surface of the lower substrate corresponding to the second anode wire; and a plurality of surface-unsaturated carbon nanotubes formed on the second cathode wire.

The present invention grows carbon nanotubes in the getter area of the field emission system for absorbing residual gas within the field emission system. The carbon nanotubes have become surface-unsaturated getting material by aging process and then have capability of absorbing residual gas within the system to improve the vacuum level of the system. In addition, the surface-unsaturated carbon nanotubes as the getting material also can be formed on other non-display areas outside pixel areas of the field emission system.

In one another aspect, the present invention provides a method for improving vacuum of the present field emission system. Before sealing the system, from the field emission area to the getter area, sequentially providing energy to the carbon nanotubes growing on the first cathode wires and second cathode wires such that gas bonding on the carbon nanotubes' surfaces and residual gas accumulated in interstices of the stacking carbon nanotubes absorb the energy and are released. Thereafter, removing the residual gas within the system and sealing the system.

The method for improving vacuum of the field emission system of the present invention can be integrated in standard processes of field emission display devices without additional fabricating steps, thus facilitating mass production of the field emission display devices. Moreover, it is unnecessary to add a getter device to the present field emission system. The fabricating cost can be reduced. The system's thickness and weight also can be decreased.

DETAILED DESCRIPTION OF THE PREFERRED EMBODIMENTS

The carbon nanotubes are employed as field emitters in the field emission display device. The carbon nanotubes have large surface areas easily bonding gas thereto and the carbon nanotubes growing by the conventional ways are easily stacked together to result in gas accumulation in the interstices of the stacking carbon nanotubes. The above process disadvantages often cause the field emission effect unclear, and affecting the illuminating efficiency of the display panel. As such, before gas exhausting until vacuum inside the panel, the conventional processes employ an aging process on the carbon nanotubes to release gas bonding to their surfaces and accumulated in the interstices of the stacking carbon nanotubes to stabilize the vacuum. inside the panel and improve field emission performance. The present invention utilizes the characteristic of the carbon nanotubes whose surfaces easily absorb gas to grow the carbon nanotubes in the non-display area of the field emission display, and aging the carbon nanotubes to become absorbing material having surface-unsaturated and gas-absorbing properties. The surface-unsaturated carbon nanotubes absorb residual gas inside the panel after sealing it so as to improve and maintain the vacuum level inside the panel.

In other words, the present invention provides a getter mechanism, which grows surface-unsaturated carbon nanotubes in the non-display area of the field emission system such that after sealing the field emission system, the surface-unsaturated carbon nanotubes absorb residual gas within the system to improve the vacuum level inside the system.

The field emission system and the method for improving its vacuum of the present invention will be described in detail in the following according to preferred embodiments with reference to accompanying drawings. Besides, the field emission system of the present invention also is applicable in illuminating systems such as a backlight source.

Figure 1:
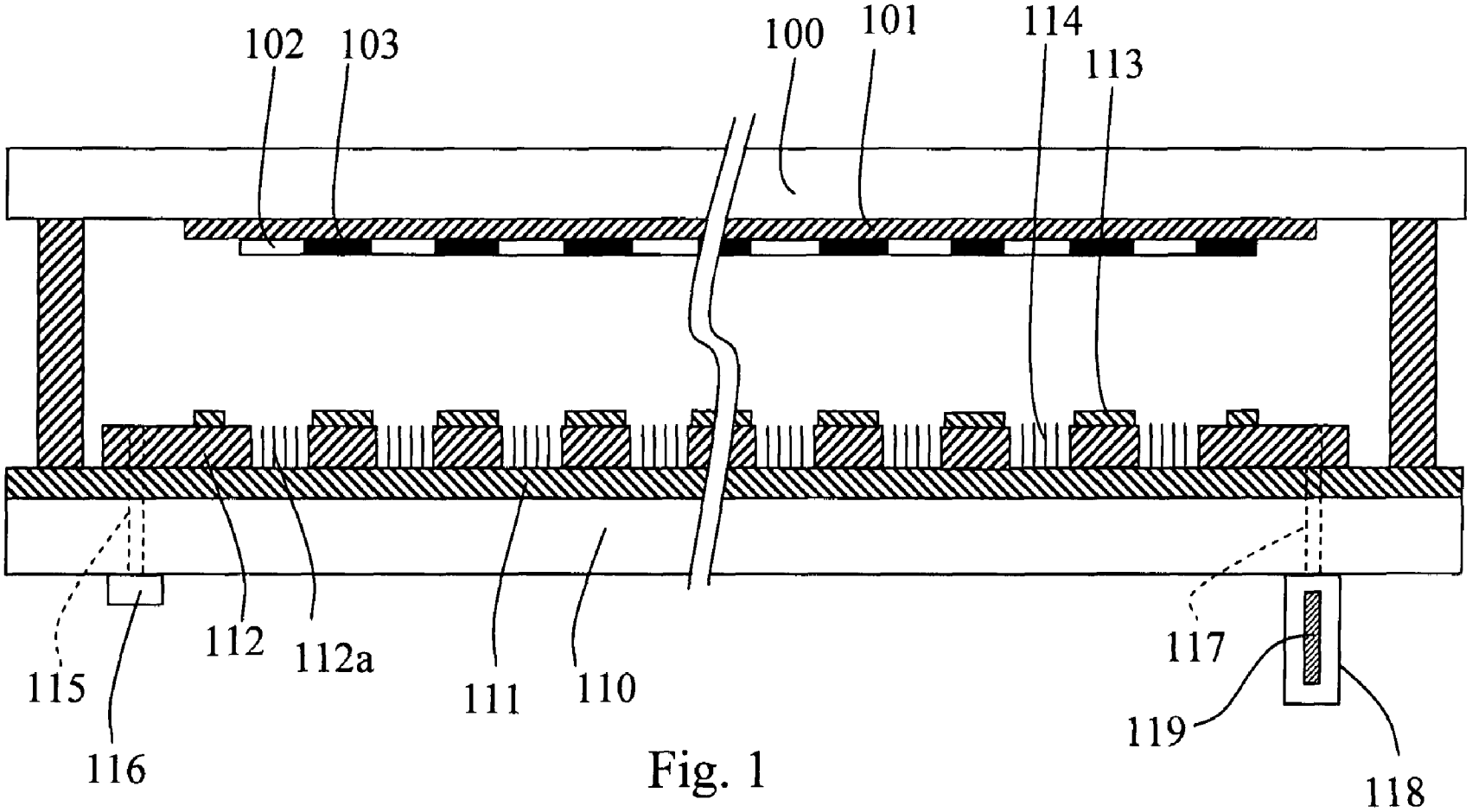
Fig. 1 (Prior Art)
FIG. 1 is a schematic cross-sectional view of a conventional field emission display device.
Figure 2A:
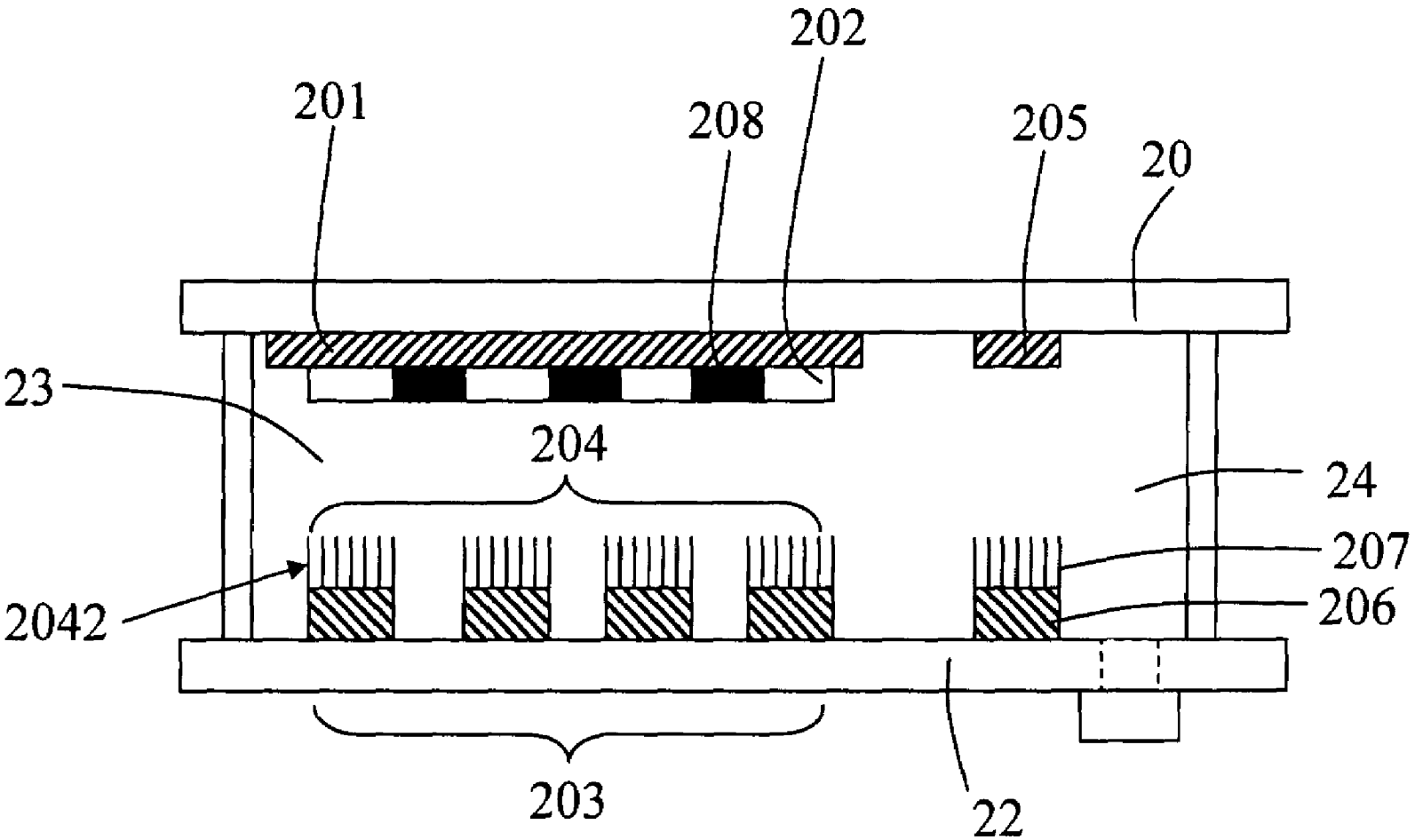
FIG. 2A is a schematic cross-sectional view of a field emission system according to a first embodiment of the present invention.

FIG. 2A is a schematic cross-sectional view of a field emission system according to a first embodiment of the present invention. In the first embodiment, the field emission system is a field emission display device, comprising an upper substrate 20; a lower substrate 22 disposed under the upper substrate 20 and a display area (field emission area) 23 and a getter area 24 defined therebetween; an anode array 201 formed on an inner surface of the upper substrate 20 corresponding to the display area 23 and including a plurality of first anode wires; a phosphor layer 202 formed under the anode array 201; a cathode array 203 formed on an inner surface of the lower substrate 22 corresponding to the anode array 201 and including a plurality of first cathode wires; a carbon nanotube field emission array 204 including a plurality of carbon nanotube units 2042 formed on the at least one first cathode wire and each of the carbon nanotube units 2042 including a plurality of carbon nantubes corresponding to a pixel unit; at least one second anode wire 205 formed on the inner surface of the upper substrate 20 corresponding to the getter area 24; at least one second cathode wire 206 formed on the inner surface of the lower substrate 22 corresponding to the second anode wire 205; a plurality of surface-unsaturated carbon nanotubes 207 formed on the second cathode wire 206; and a black matrix 208 formed in the phosphor layer 202 and inter-disposed with the pixel units for improving contrast and color purity of the field emission display device. The upper substrate 20 is a transparent substrate, such as glass substrate, and the lower substrate 22 can be a transparent or non-transparent substrate.

Before sealing the panel of the field emission display of the first embodiment, the aging process is performed unto the carbon nanotube units 2042 in the display area 23 and the carbon nanotubes 207 in the getter area 24 such that the gases bonding to the surfaces of the carbon nanotubes and accumulated in the interstices of the stacking carbon nanotubes are released, and the carbon nanotubes 207 in the getter area 24 become surface-unsaturated absorbing material. The residual gas within the system is exhausted by a vacuum system, and then the panel is sealed. While the field emission display is operated, voltage is not applied to the second anode wire 205 and the second cathode wire 206 of the getter area 24. As such, the carbon nanotubes 207 are only functioned as getter agent but do not provide field emission.

In addition, the surface-unsaturated carbon nanotubes also can be formed on other non-display areas such as the inner surface areas of the lower substrate 22 corresponding to the black matrix 208 as getter material (not shown), and the voltage is not applied to these surface-unsaturated carbon nanotubes, while the field emission display is operated, such that these surface-unsaturated carbon nanotubes are only functioned as getter agent.

Figure 2B:
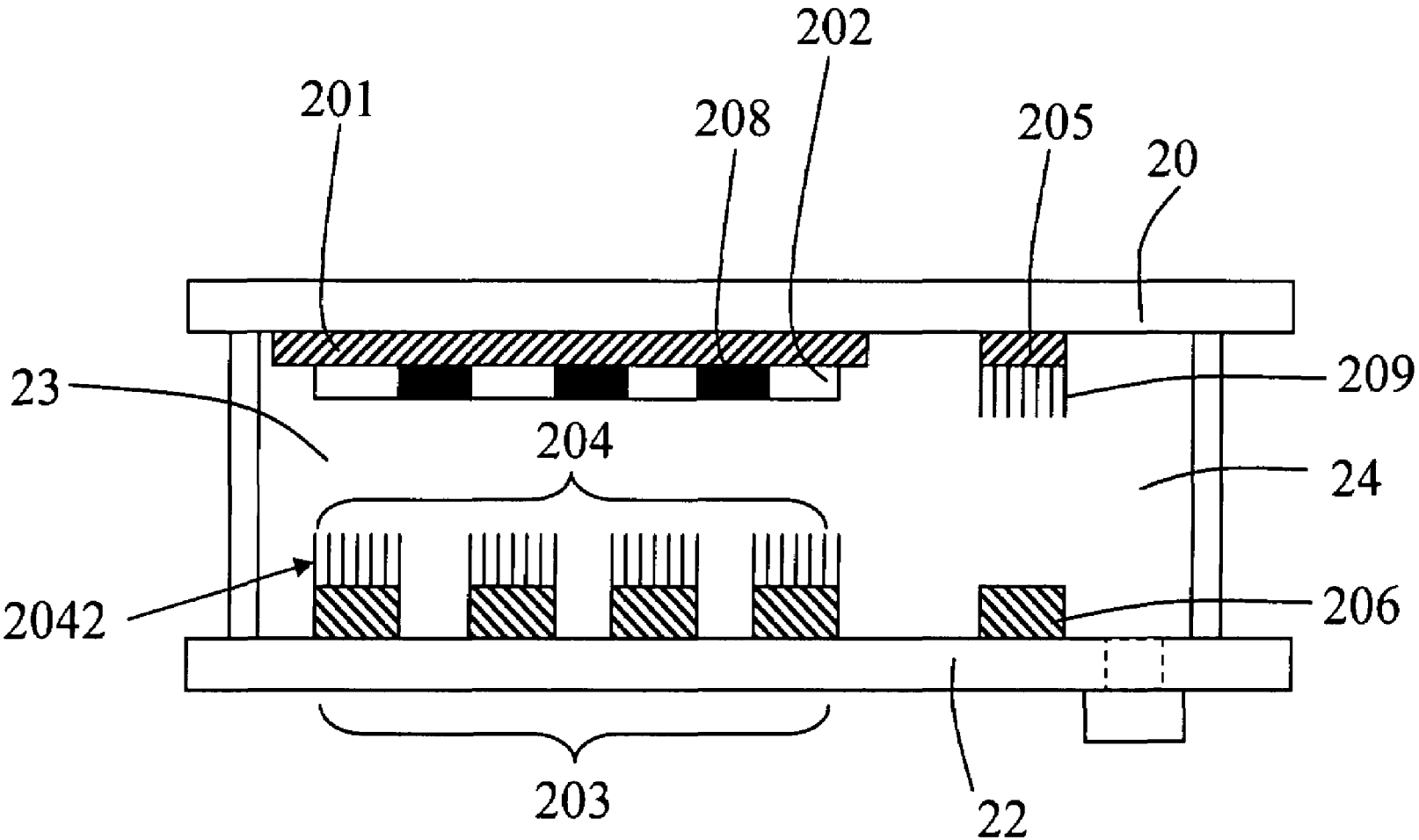
FIG. 2B is a schematic cross-sectional view of a field emission system according to a second embodiment of the present invention.

FIG. 2B is a schematic cross-sectional view of a field emission system according to a second embodiment of the present invention, and which is also applicable in the field emission display device. The difference between the second embodiment and first embodiment is that the surface-unsaturated carbon nanotubes 209 in the getter area 24 grow on the second anode wire 205, and the other components are the same with the field emission display device of the first embodiment.

Figure 3:
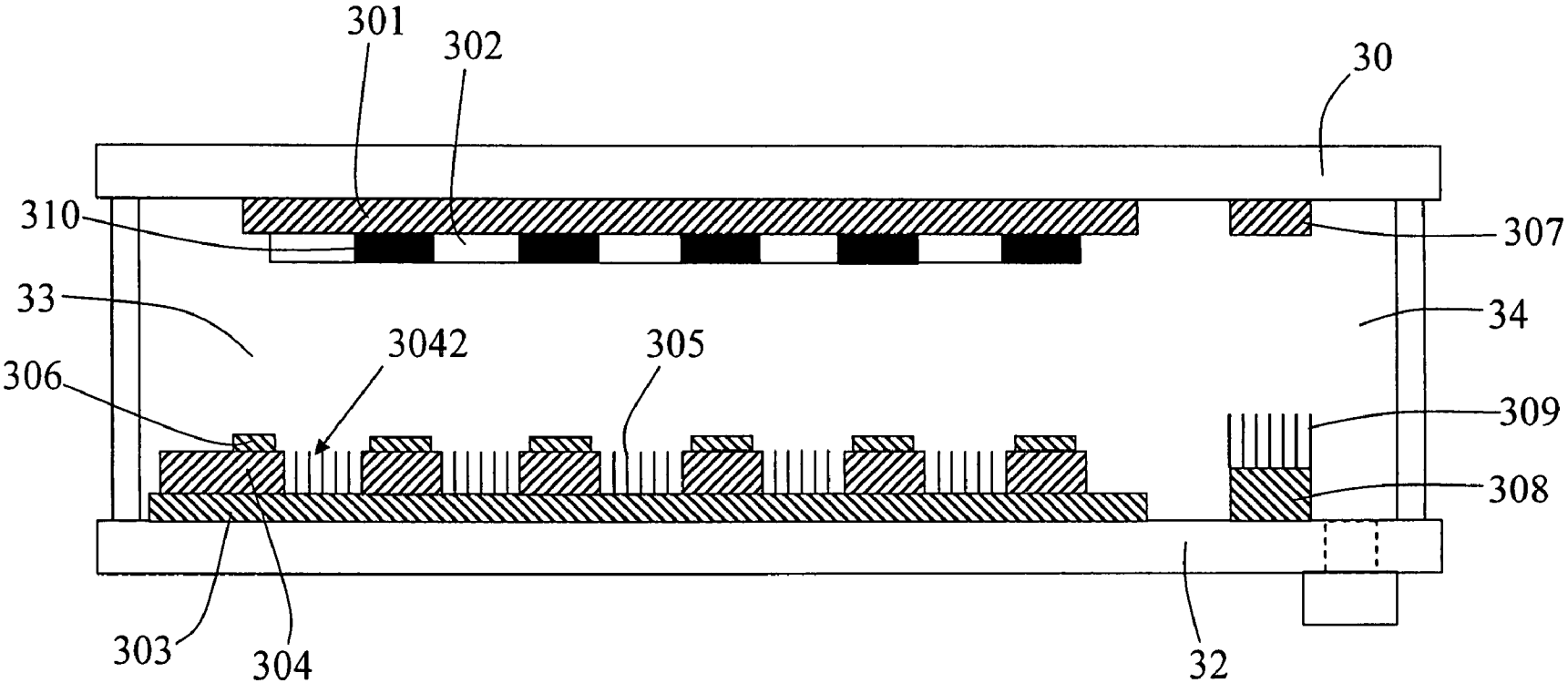
FIG. 3 is a schematic cross-sectional view of a field emission system according to a third embodiment of the present invention.

FIG. 3 is a schematic cross-sectional view of a field emission system according to a third embodiment of the present invention, and which is also applicable in the field emission display device. In the third embodiment, the field emission display device of the present invention comprises an upper substrate 30; a lower substrate 32 disposed under the upper substrate 30 and a display area 33 and a getter area 34 defined therebetween; an anode array 301 formed on an inner surface of the upper substrate 30 corresponding to the display area 33 and including a plurality of first anode wires; a phosphor layer 302 formed under the anode array 301; a cathode array 303 formed on an inner surface of the lower substrate 32 corresponding to the anode array 302 and including a plurality of first cathode wires; a dielectric layer 304 formed on the cathode array 303 and having a plurality of holes 3042 formed therein for exposing partial portions of the cathode wires; a plurality of carbon nanotube units 305 formed on the exposed partial portions of the cathode wires in the holes 3042 and each of the carbon nanotube units 305 corresponding to one pixel unit; a plurality of gate electrodes 306 formed on the dielectric layer 304 respectively corresponding to the holes 3042; at least one second anode wire 307 formed on the inner surface of the upper substrate 30 corresponding to the getter area 34; at least one second cathode wire 308 formed on the inner surface of the lower substrate 32 corresponding to the second anode wire 307; a plurality of surface-unsaturated carbon nanotubes 309 formed on the second cathode wire 308; and a black matrix 310 formed in the phosphor layer 302 and inter-disposed with the pixel units for improving contrast and color purity of the present field emission display. The gate electrodes 306 provide a driving voltage for driving the carbon nanotubes 305 in the display area 33 to emit electrons. Because the gate electrodes 306 are closer to the carbon nanotubes 305, the lower operation voltage is applied to the first anode array 301.

Similarly, before sealing the panel of the field emission display device of the third embodiment, the aging process is performed unto the carbon nanotube units 305 in the display area 33 and the carbon nanotubes 309 in the getter area 34 such that the gases bonding to the surfaces of the carbon nanotubes and accumulated in the interstices of the stacking carbon nanotubes are released, and the carbon nanotubes 309 in the getter area 34 become surface-unsaturated absorbing material. The residual gas within the system is exhausted by the vacuum system, and then the panel is sealed. While the field emission display device is operated, the voltage is not applied to the second anode wire 307 and the second cathode wire 308 of the getter area 34. Thus, the carbon nanotubes 309 are only functioned as getter agent but do not provide field emission. Alternatively, the carbon nanotubes 309 in the getter area 34 also can grow on the second anode wire 307.

Figure 4B:
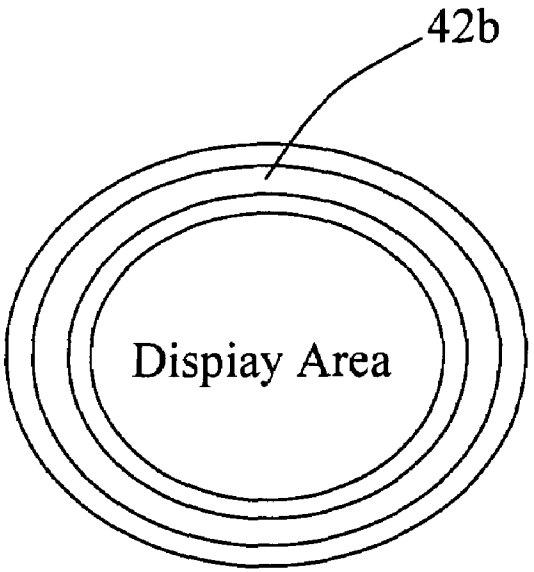
FIG. 4B is a schematic top view of another variance of the field emission system of the first embodiment of the present invention.
Figure 4A:
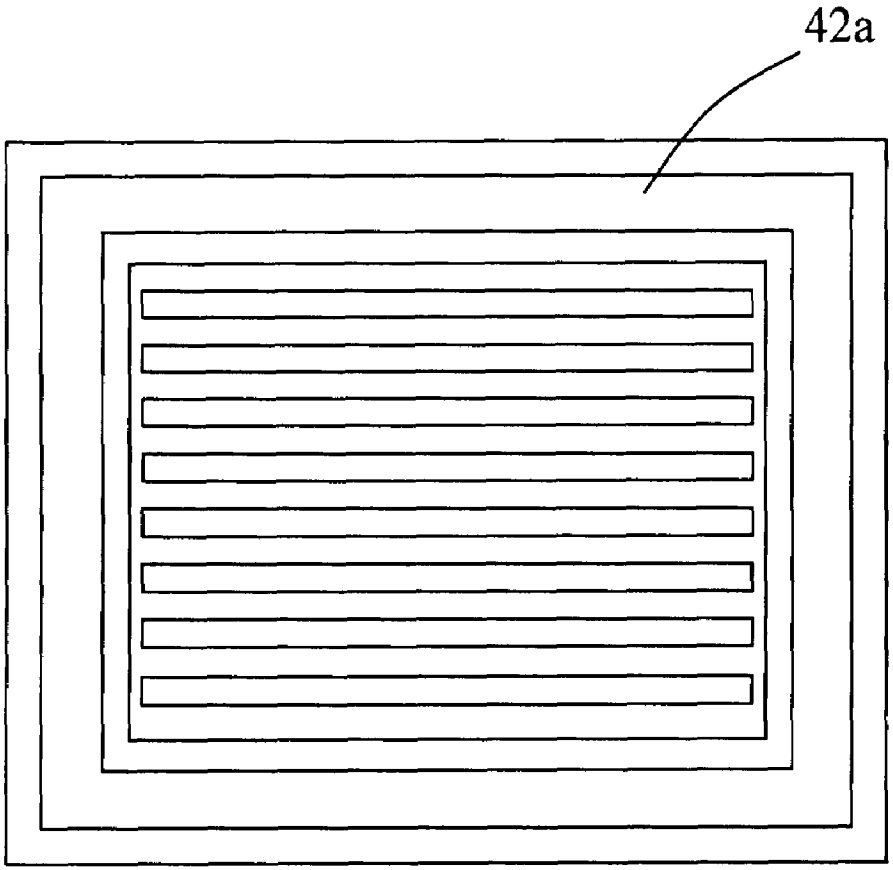
FIG. 4A is a schematic top view of a variance of the field emission system of the first embodiment of the present invention.

The geometric shape of the getter area of the present field emission display device can be varied according to the shape of the display panel, the carbon nanotubes grow and arrange in a way depending on the geometric shape of the getter area. Referring to FIG. 4A and FIG. 4B, the getter area can be designed as a rectangular area 42*a* or an elliptical area 42*b* around the display panel of the present field emission display device. Otherwise, the getter area also can be designed to have a geometric shape of circle, annulus or polygon, etc.

Besides, the field emission system of the present invention can be served as a backlight module. Under this situation, the phosphor layer does not need to be provided with a black matrix therein.

Figure 5B:
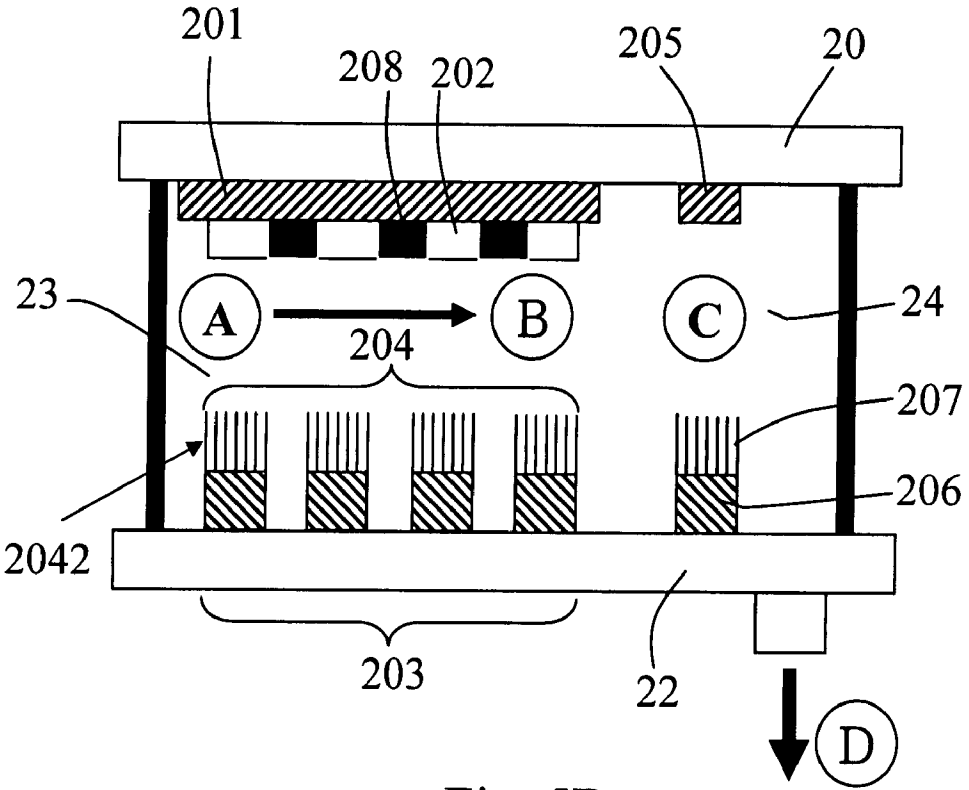
FIG. 5B is a schematic cross-sectional view of the field emission system of FIG. 5A.
Figure 5A:
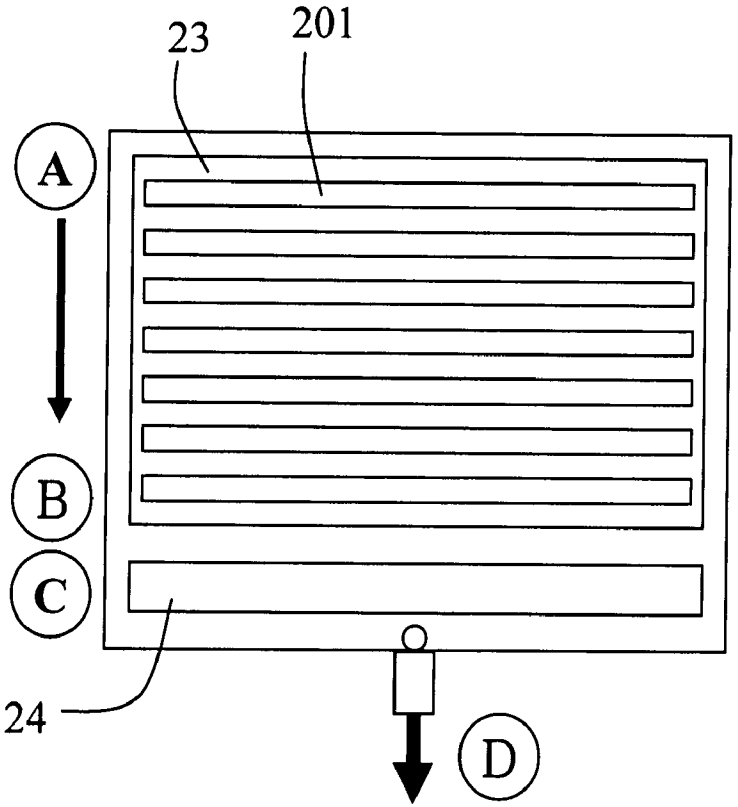
FIG. 5A is a schematic top view of the field emission system of the first embodiment of the present invention, which shows an aging process of the present invention.

On the other hand, the present invention provides a method for improving the vacuum of the field emission system. Before sealing the field emission system, the aging process is applied to the carbon nanotubes in the field emission area and the getter area by external stimulus such that the gases bonding to the surfaces of the carbon nanotubes and accumulated in the interstices of the stacking carbon nanotubes are released, and the carbon nanotubes in the getter area become surface-unsaturated absorbing nanomaterial. The residual gas within the system is exhausted by the vacuum system, and then the panel is sealed. After sealing the system, the surface-unsaturated carbon nanotubes in the getter area serve as getter agent to absorb the residual gas within the system to improve the system vacuum. FIG. 5A and FIG. 5B respectively are a schematic top view and a cross-sectional view of the field emission display device of the first embodiment of the present invention. The aging process of the present invention is performed from the display area 23 to the getter area 24 by sequentially applying energy to the carbon nanotubes of each of the first cathode wire and the second cathode wire 206. The gases bonding to the surfaces of the carbon nanotubes and accumulated in the interstices of the stacking carbon nanotubes will absorb the energy and then are released. The energy can be provided by way of applying electric field or heat to the carbon nanotubes. Alternatively, the carbon nanotubes also can be activated by other physical or chemical methods to release the gases bonding to the surfaces of the carbon nanotubes and accumulated in the interstices of the stacking carbon nanotubes.

The present invention provides a getter mechanism that employs the aging surface-unsaturated carbon nanotubes in the non-display area to serve as the getter agent of the present field emission system. The present getter structure can be integrated in standard processes of the field emission display devices without additional fabricating steps. The fabricating cost can be decreased, and advantageously mass-producing the field emission display devices. Moreover, it is unnecessary to add a getter device in the present field emission system. The thickness and weight of the system can be decreased.

While the invention will be described by way of examples and in terms of preferred embodiments, it is to be understood that those who are familiar with the subject art can carry out various modifications and similar arrangements and procedures described in the present invention and also achieve the effectiveness of the present invention. Hence, it is to be understood that the description of the present invention should be accorded with the broadest interpretation to those who are familiar with the subject art, and the invention is not limited thereto.

What is claimed is:

1. A field emission system, comprising:

an upper substrate;

a lower substrate disposed under said upper substrate and a field emission area and a getter area defined therebetween;

an anode array formed on an inner surface of said upper substrate corresponding to said field emission area and including at least one first anode wire;

a phosphor layer formed under said anode array;

a cathode array formed on an inner surface of said lower substrate corresponding to said anode array and including at least one first cathode wire;

a carbon nanotube (CNT) field emission array including a plurality of CNT units formed on said at least one first cathode wire and each of said CNT units including a plurality of carbon nanotubes;

at least one second anode wire formed on said inner surface of said upper substrate corresponding to said getter area;

at least one second cathode wire formed on said inner surface of said lower substrate corresponding to said second anode wire; and a plurality of surface-unsaturated carbon nanotubes formed on said second cathode wire.

2. The field emission system of claim 1, further comprising a black matrix formed in said phosphor layer and a plurality of surface-unsaturated carbon nanotubes formed on the inner surface areas of the lower substrate corresponding to the black matrix.

3. The field emission system of claim 1, wherein said getter area has a geometric shape selected from the group consisting of circle, ellipse, rectangle, annulus and polygon.

4. The field emission system of claim 1, wherein while said field emission system is operated, said getter area does not provide field emission.

5. The field emission system of claim 1, wherein said field emission system is provided as a field emission display (FED) or a backlight source.

6. A field emission system, comprising:

an upper substrate;

a lower substrate disposed under said upper substrate and a field emission area and a getter area defined therebetween;

an anode array formed on an inner surface of said upper substrate corresponding to said field emission area and including at least one first anode wire;

a phosphor layer formed under said anode array;

a cathode array formed on an inner surface of said lower substrate corresponding to said anode array and including at least one first cathode wire;

a CNT field emission array including a plurality of CNT units formed on said at least one first cathode wire and each of said CNT units including a plurality of carbon nanotubes;

at least one second anode wire formed on said inner surface of said upper substrate corresponding to said getter area;

at least one second cathode wire formed on said inner surface of said lower substrate corresponding to said second anode wire; and a plurality of surface-unsaturated carbon nanotubes formed on said second anode wire.

7. The field emission system of claim 6, further comprising a black matrix formed in said phosphor layer and a plurality of surface-unsaturated carbon nanotubes formed on the inner surface areas of the lower substrate corresponding to the black matrix.

8. The field emission system of claim 6, wherein said getter area has a geometric shape selected from the group consisting of circle, ellipse, rectangle, annulus and polygon.

9. The field emission system of claim 6, wherein while said field emission system is operated, said getter area does not provide field emission.

10. The field emission system of claim 6, wherein said field emission system is provided as a field emission display or a backlight source.

11. A field emission system, comprising:

an upper substrate;

a lower substrate disposed under said upper substrate and a field emission area and a getter area defined therebetween;

an anode array formed on an inner surface of said upper substrate corresponding to said field emission area and including at least one first anode wire;

a phosphor layer formed under said anode array;

a cathode array formed on an inner surface of said lower substrate corresponding to said anode array and including at least one first cathode wire;

a dielectric layer formed on said cathode array and having a plurality of holes formed therein for exposing partial portions of said cathode wires;

a plurality of carbon nanotube units formed on said partial portions of said cathode wires within said holes;

a plurality of gate electrodes formed on said dielectric layer respectively corresponding to said holes;

at least one second anode wire formed on said inner surface of said upper substrate corresponding to said getter area;

at least one second cathode wire formed on said inner surface of said lower substrate corresponding to said second anode wire; and a plurality of surface-unsaturated carbon nanotubes formed on said second cathode wire.

12. The field emission system of claim 11, further comprising a black matrix formed in said phosphor layer.

13. The field emission system of claim 11, wherein said getter area has a geometric shape selected from the group consisting of circle, ellipse, rectangle, annulus and polygon.

14. The field emission system of claim 11, wherein while said field emission system is operated, said getter area does not provide field emission.

15. The field emission system of claim 11, wherein said field emission system is provided as a filed emission display or a backlight source.

16. A field emission system, comprising:

an upper substrate;

a lower substrate disposed under said upper substrate and a field emission area and a getter area defined therebetween;

an anode array formed on an inner surface of said upper substrate corresponding to said field emission area and including at least one first anode wire;

a phosphor layer formed under said anode array;

a cathode array formed on an inner surface of said lower substrate corresponding to said anode array and including at least one first cathode wire;

a dielectric layer formed on said cathode array and having a plurality of holes formed therein for exposing partial portions of said cathode wires;

a plurality of carbon nanotube units formed on said partial portions of said cathode wires within said holes;

a plurality of gate electrodes formed on said dielectric layer respectively corresponding to said holes;

at least one second anode wire formed on said inner surface of said upper substrate corresponding to said getter area;

at least one second cathode wire formed on said inner surface of said lower substrate corresponding to said second anode wire; and a plurality of surface-unsaturated carbon nanotubes formed on said second anode wire.

17. The field emission system of claim 16, further comprising a black matrix formed in said phosphor layer.

18. The field emission system of claim 16, wherein said getter area has a geometric shape selected from the group consisting of circle, ellipse, rectangle, annulus and polygon.

19. The field emission system of claim 16, wherein while said field emission system is operated, said getter area does not provide field emission.

20. The field emission system of claim 16, wherein said field emission system is provided as a field emission display or a backlight source.

21. A method for improving vacuum level of a vacuum system, by which aging surface-unsaturated carbon nanotubes are provided in said system as getter material to improve vacuum of said system.

22. The method for improving system vacuum of claim 21, wherein said system is a field emission system including a field emission area and a getter area, said method comprises:

from said field emission area to said getter area, sequentially providing external stimulus to carbon nanotube units formed therein to age carbon nanotubes of said carbon nanotube units;

removing residual gases within said field emission system; and sealing said field emission system.

23. The method for improving system vacuum of claim 22, wherein the external stimulus is provided to said carbon nanotubes by electric field, heat or other physical or chemical methods.

* * * * *